United States Patent [19]

Spooren

[11] Patent Number: 4,778,396

[45] Date of Patent: Oct. 18, 1988

[54] ELECTRICAL CONNECTOR HAVING COMPLIANT POSTS AND IMPROVED INSERTION CHARACTERISTICS

[75] Inventor: Martin J. A. Spooren, Cromvoirt, Netherlands

[73] Assignee: AMP Incorporated, Harrisburg, Pa.

[21] Appl. No.: 577,428

[22] Filed: Feb. 6, 1984

[51] Int. Cl.[4] ..... H01R 13/428

[52] U.S. Cl. ..... 439/82; 439/682

[58] Field of Search ..... 339/17 C, 220 R, 221 R, 339/221 M, 217 S; 439/81–83, 746–749, 751, 872, 873, 733, 682, 686, 690, 691

[56] References Cited

U.S. PATENT DOCUMENTS

| | | | |
|---|---|---|---|
| 2,352,618 | 7/1944 | Daent | 339/217 S |
| 2,861,253 | 11/1958 | Johanson | 339/217 S |
| 3,975,072 | 8/1976 | Ammon | 339/17 |
| 4,045,868 | 9/1977 | Ammon et al. | 29/629 |
| 4,077,694 | 3/1978 | Cobaugh et al. | 339/176 |
| 4,127,935 | 12/1978 | Ammon | 29/629 |
| 4,361,773 | 11/1982 | Mokrzycki | 339/217 S |
| 4,383,361 | 5/1983 | Kautz | 29/739 |
| 4,396,245 | 8/1983 | Lane | 339/38 |

FOREIGN PATENT DOCUMENTS

| | | | |
|---|---|---|---|
| 684703 | 12/1952 | United Kingdom | 339/217 S |

*Primary Examiner*—Gil Weidenfeld
*Assistant Examiner*—Gary F. Paumen
*Attorney, Agent, or Firm*—Frederick W. Raring

[57] ABSTRACT

Electrical connector assembly comprises an insulating housing having terminals in terminal-receiving cavities in the housing. The terminals have post portions which extend from a mounting face, the post portions being intended for insertion into plated holes in a panel-like member. The post portions have compliant spring portions that are compressed upon insertion and establish contact with the plated metal in the holes. The assembly has improved force transmitting surfaces on the terminals and on the walls of the terminal-receiving cavities so that the assembly can be assembled to the panel-like member by merely aligning the post portions with the holes and applying insertion forces to the face of the housing which is opposite to the mounting face.

5 Claims, 3 Drawing Sheets

ELECTRICAL CONNECTOR HAVING COMPLIANT POSTS AND IMPROVED INSERTION CHARACTERISTICS

FIELD OF THE INVENTION

This invention relates to electrical connectors of the type which have terminals therein that have compliant pin-type terminal posts. The terminal posts are inserted into plated holes in a panel-like member and the compliant pins are compressed and establish contact with the plating on the surface of the holes. The invention is particularly directed to a connector which can be assembled to the panel-like member by merely aligning the terminal posts with the holes and pressing on the connector housing to force the posts into the holes and the panel-like member.

BACKGROUND OF THE INVENTION

U.S. Pat. No. 4,186,982 describes an electrical connector of the type which is intended to be mounted on a large panel-like member, usually referred to as a mother board, and which has holes extending therethrough that are plated on their surfaces. The connector has terminal posts which have compliant portions that can be forced into the holes so that electrical contact will be established with the plated surfaces of the holes. Connectors of this type avoid the requirement that the terminal posts be soldered to conductors on the mother board and for that reason have been widely adopted in the electronics industry.

When a connector assembly of the type described above is assembled to a mother board, a relatively high insertion force must be brought to bear on each of the terminals to force the compliant portion of the terminal post into the plated hole in the mother board. For a common type of connector, this force required for insertion is in the range of 100–130N (Newton) although the force may go as high as 180N when unfavorable tolerances in the terminals and in the holes are involved. Since the housings are of plastic and ordinarily cannot withstand an extremely high compressive force, it is common practice to assemble connectors of the type under consideration to the mother board by designing the terminals and the terminal-receiving cavities in the housing such that insertion punches can be inserted into the cavities and brought to bear against shoulders on the terminals. The insertion punches push the terminals into the holes and the housing is not stressed during the assembly operation. This method of assembly is inconvenient in that the tooling is expensive and complex in that it requires a "special" dedicated insertion punch for each terminal in the connector housing and different types of tooling are required for different types of connectors.

It has been suggested that the connector assembly be designed such that the insertion forces might be applied directly to the connector housing and transmitted through the housing to the terminals rather than applying the insertion force directly to the terminals by the use of separate insertion punches. In fact, one type of connector is available which does use this principle, the terminals having a single laterally extending ear and the terminal-receiving cavities of the housing having a shoulder surface which bears against the ear so that the insertion forces can be applied directly to the housing. This available connector is being used successfully but it has some comparative disadvantages; for example, it was found necessary to design the connector housing in two parts which must be assembled to each other thereby increasing the manufacturing cost over a comparable one-piece housing connector assembly. Furthermore, the arrangement is such that the insertion forces are applied to the ear along a force line which is spaced from the axis of the terminal; in other words, the terminal is eccentrically loaded during insertion and this is undesirable.

The present invention is directed to the achievement of an improved connector of the type described above and capable of being assembled to the mother board by direct application of the insertion force to the connector housing.

An electrical connector assembly in accordance with the invention is of the type comprising an insulating housing having a mounting face and an opposite face which is oppositely directed with respect to the mounting face, a plurality of terminal receiving cavities extending into the housing from the mounting face and a stamped and formed sheet metal terminal in each of the cavities. Each of the terminals has a post portion which extends outwardly from the mounting face, the connector assembly being intended for mounting on one surface of a panel with the mounting face opposed to the one surface of the panel and with the post portions extending into post-receiving holes in the panel. The posts have interference fits in the post-receiving holes and the connector assembly has force receiving and transmitting portions which receive insertion forces and transmit the insertion forces to the post portions when the connector assembly is assembled to the panel and the post portions are forced into the post-receiving holes in the panel. The connector assembly is characterized in that each of the terminals has a longitudinal terminal axis extending inwardly from the mounting face towards the opposite face. Each terminal further has a yoke portion which is proximate to the mounting face, a shank portion extending along the terminal axis towards the opposite face centrally from the yoke portion, and a pair of ears extending from the yoke portion on a first pair of opposite sides of the shank portion. The ears extend laterally of the terminal axis and have force-transmitting surface portions which face towards the opposite face. Each of the cavities is enlarged adjacent to the mounting face for reception of the yoke portion and the ears. Each cavity has force transmitting cavity wall surface portions which are opposed to, and against, the force transmitting surface portions of the ears to that upon loading the connector assembly adjacent to the one surface of the panel with the post portions of the terminals extending into the post-receiving holes and upon application of insertion forces to the opposite face, the opposite face will function as a force-receiving face and the insertion forces will be transmitted through the housing and through the force transmitting surface portions of the cavities and the ears to the posts and the posts will be driven into the post-receiving holes.

A further embodiment is characterized in that the shank portion has a second pair of opposite sides which extend normally of the first pair of opposite sides, the second pair of opposite sides and the adjoining sides of the yoke portions being the rolled surfaces, the first pair of opposite sides being the sheared edge surfaces. Each of the ears has a fixed end and a free end, the fixed ends being integral with the yoke portion. The ears extend obliquely with respect to the terminal axis from their fixed ends at an angle in the range of about 30° to 60°.

A further embodiment is characterized in that the force transmitting surface portion of each of the ears extends from the fixed end of the ear to the free end, the force transmitting cavity wall surface portions associated with each ear extending to a location adjacent to the fixed end of the ear and the force transmitting surface portion of each ear are, in part, beside the shank portion. A further embodiment is characterized in that the free end of each ear has an edge which is between the rolled surface and the sheared surface and the force transmitting surface portions extend past the edge and include the adjacent sheared surface. A further embodiment is characterized in that the housing is a one-piece molding, the terminals having been inserted into the housing from the mounting face, the yoke portions of the terminals having rearwardly facing shoulder surfaces which are co-planar with the mounting face.

THE DRAWING FIGURES

Figure 3:
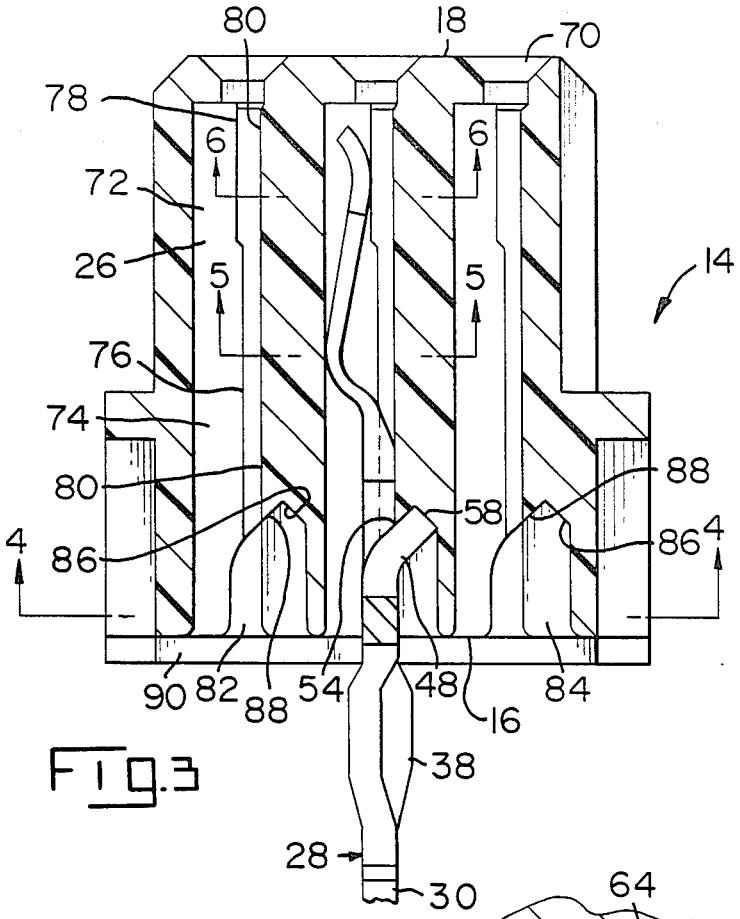
FIG. 3 is a cross-sectional view of the housing showing a terminal positioned in one of the cavities shown.
Figure 4:
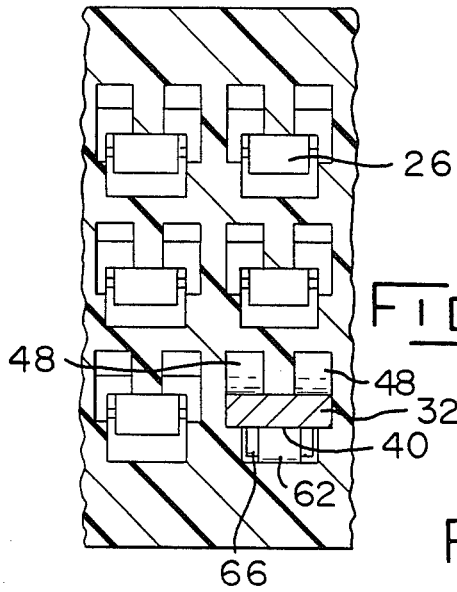
Figure 5:
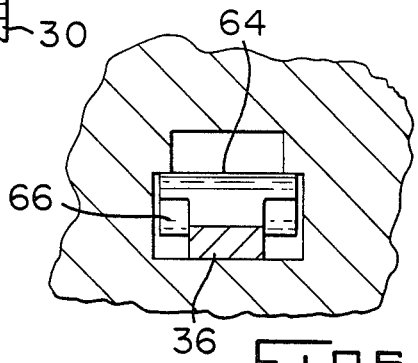
Figure 6:
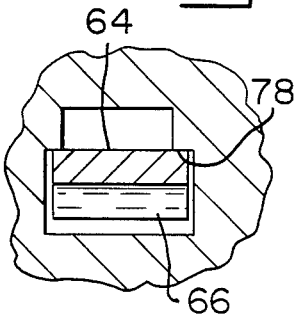

FIGS. 4, 5, and 6 are views taken along the lines 4—4, 5—5, and 6—6 of FIG. 3.

Figure 7:
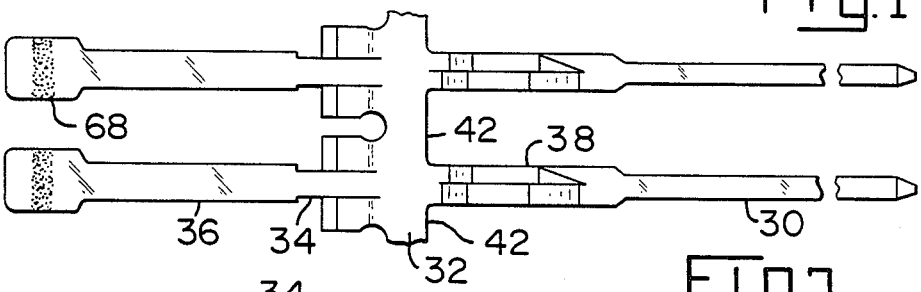

FIG. 7 is a plan view of a short section of terminal strip.

Figure 8:
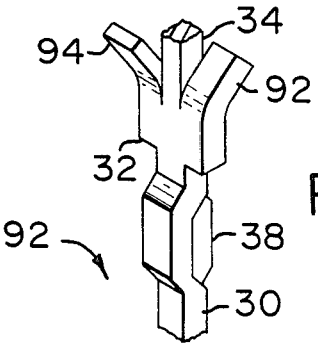

FIG. 8 is a perspective view of an alternative embodiment.

THE DISCLOSED EMBODIMENT

Figure 1:
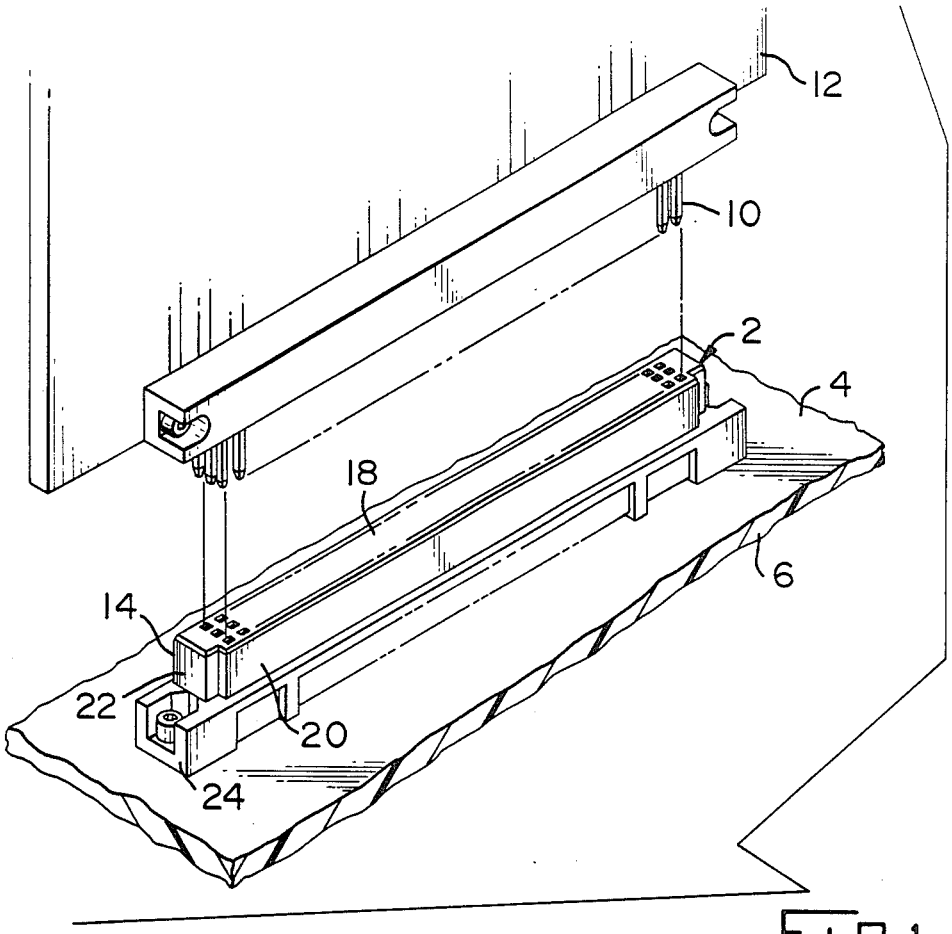
FIG. 1 is a perspective view showing a connector in accordance with the invention positioned above a panel-like member.
Figure 2:
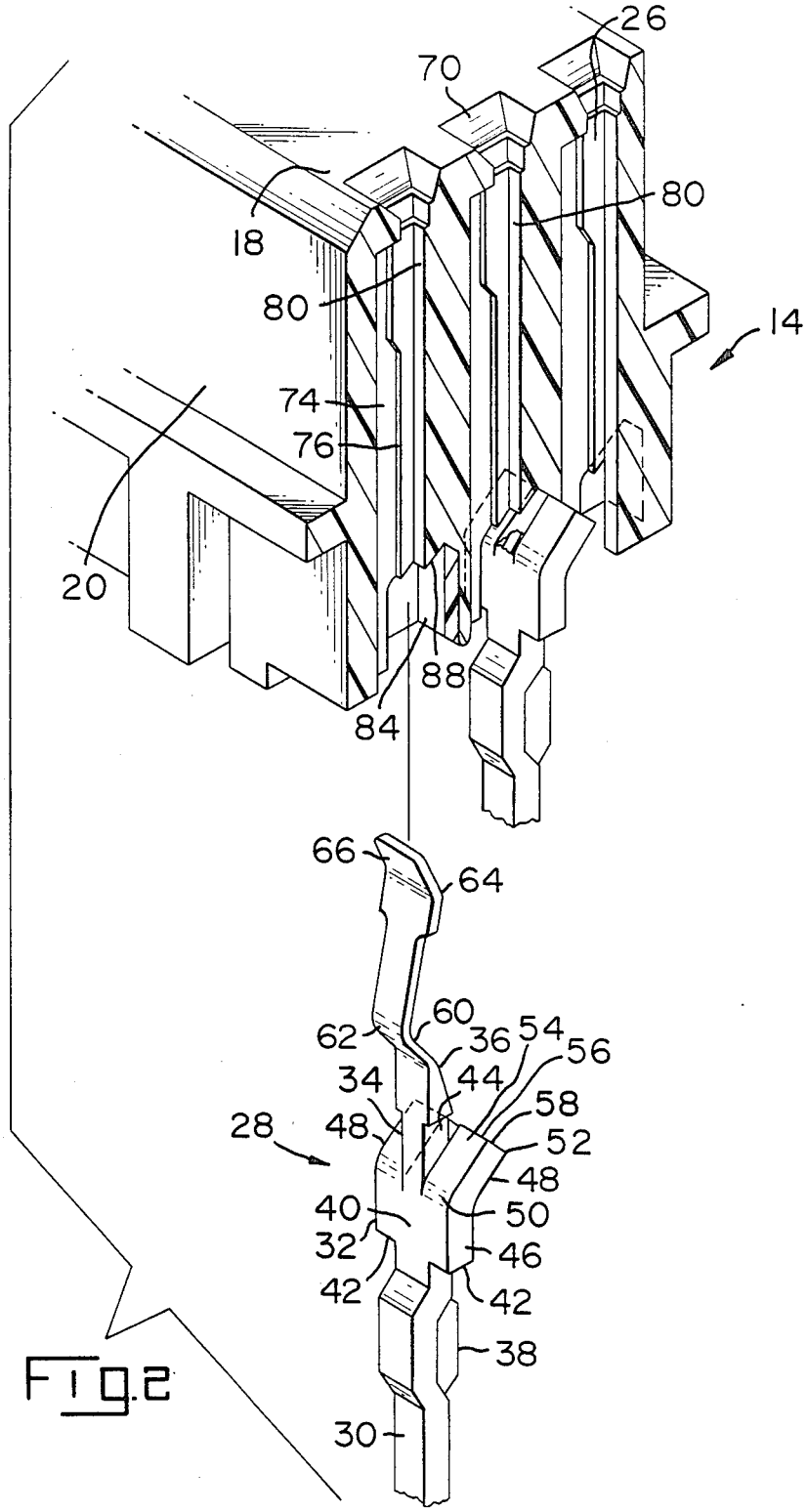
FIG. 2 is a sectional perspective view of a connector housing having a terminal exploded from one of the terminal-receiving cavities in the housing.

Referring to FIGS. 1-3, the embodiment of the invention disclosed comprises a connector assembly 2 which is intended for mounting on the upper surface 4 of a panel-like member or mother board 6 having holes therein which receive post portions of terminals described below. The connector is adapted to receive contact pins 10 extending from a smaller circuit board 12, commonly referred to as a daughter board so that conductors or components on the circuit board 12 can be connected to conductors on the underside of the mother board 6.

The connector assembly 2 comprises an insulating housing 14 having a lower face or mounting face 16 which is opposed to the surface 4 when the connector is mounted on the circuit board 6. The housing has an opposite face 18 which faces oppositely with respect to the mounting face 16 and which in the disclosed embodiment is the mating face of the connector. The housing has sidewalls 20, endwalls 22 and ears 24 which extend from the endwalls and which have openings for reception of fasteners to secure the housing to the mother board 6. A plurality of terminal-receiving cavities 26 extend through the housing from the mating face 18 to the mounting face 16 and a terminal 18 is contained in each of the cavities.

The housing is of plastic material, preferably a thermoplastic polyester which is filled with about 30% glass fibers for purposes of enhanced strength and hardness. Other plastic materials having comparable physical properties can also be used.

Referring now to FIGS. 2 and 7, the terminals are of stamped and formed sheet metal such as a suitable phosphor bronze in a relatively hard temper so that a good electrical connection will be contained with the plated holes 8 in the panel member 6. The terminals are manufactured in continuous strip form as shown in FIG. 7 and are severed from the strip at the time of insertion of the individual terminals into the cavities 26 in the connector housing 14.

Each terminal has a post portion 30 having a square cross section, a yoke portion 32, a shank portion 34 extending from the yoke portion and a contact arm portion 36 which extends from the shank. The post portion has a compliant portion 38 adjacent to the yoke portion 32 which is formed by shearing and displacing portions of the post laterally in opposite directions to form an extremely stiff spring. The width of the compliant portion is greater than the diameter of the hole so that a relatively high force is required to insert the compliant portion into the circuit board hole. For commonly used sizes of terminals, this force will be in the range of 100 to 130N although higher forces may be required under adverse conditions of hole and post tolerances. It may therefore be a requirement for a particular connector that the connector be able to withstand insertion forces of 180N for each terminal in the connector housing. As will be explained below, the present invention provides force transmitting surfaces on the terminals and in the housing that permits the insertion forces to be applied to the surface 18 of the housing rather than directly to the terminals.

The yoke portion 32 is enlarged laterally relative to the dimensions of the post portion and the adjacent shank portion 34 and has major surfaces 40 which are the flat or rolled surfaces of the terminal; that is, the surface 40 was the rolled surface of the stock material from which the terminals shown in FIG. 7 were produced. The laterally facing surfaces 46 with respect to surface 40 are sheared surfaces such as the first side surfaces 44 of the shank portion 34.

The yoke portion 32 has downwardly (as viewed in FIG. 2) facing shoulders 42 which are co-planar with the mounting face of the housing when the terminals are inserted into the housing as shown in FIG. 3. When the terminals are inserted, the force required to push the terminals into their cavities is applied against these shoulders 42.

A pair of spaced apart ears 48 are integral with and extend from the yoke portion 32, each of the ears having a fixed end 50 which is integral with the yoke and a free end 52. The ears extend in the same direction diagonally or obliquely away from the axis of the terminal at an angle of about 45° although this angle may vary from about 30° to 60° or more. The 45° angle however has been found to be the optimum for the practice of the invention. The surfaces 54 of the ears which are contiguous with the surfaces 40 of the yoke are also rolled surfaces and these surfaces 54 extend to an edge 56 at the free ends 52. A sheared surface 58 extends from the edge 56 and this surface, along with the surface 54, functions as a force transmitting surface when the connector assembly is assembled to the mother board 6.

The contact portion 36 extends from the shank 34 and is of reduced thickness along a major portion of its length. The contact arm extends laterally from the axis of the terminal as shown at 60 to a reverse bend 62 and an intermedial portion of the arm extends back towards the terminal axis to a second bend 64 from which a tip portion extends to the free end of the terminal. The end portion 66 is laterally enlarged as shown and may be selectively plated as shown at 68 in the contact zone which engages a contact pin inserted into the cavities from the mating face 18 of the housing.

The individual cavities 26 each have an entrance portion 70 extending inwardly from the mating face 18 which communicates with an elongated chamber 72 that extends to an enlarged section 82 of the cavity at the mounting face 16 of the housing. The opposed cavity walls 74 of the chamber portion 72 have ledges 76 which are spaced from the adjacent wall 80, the right-hand wall as viewed in FIG. 3, and these ledges are offset adjacent to the entrance portion 70 as shown at 78 so that the ledge portions 78 are spaced from the top wall 80 by a distance greater than the remaining portions of the ledges. By virtue of this arrangement, the contact arms 36 are flexed during insertion of the terminals into the cavities and are preloaded against the ledges prior to insertion of a contact pin which is inserted into the entrance portion for engagement with the terminal.

The enlarged sections 82 of the cavities 26 each has a pair of ear-receiving recesses 84 on each side of the center line of the cavity, these recesses 84 being dimensioned to receive the ears 48 that extend from the yoke portion 32. Each ear-receiving recess has a surface 86 which is opposed to the sheared surface 58 of the associated ear and a surface 88 which is opposed to the surface 54 of the associated ear. As shown best in FIG. 2, the surface 88 of each ear-receiving recess extends past the associated side 44 of the shank 34 of the terminal so that an extensive area of engagement is provided between the surface 54 and the surface 88 and between surfaces 58 and 56.

The surfaces 86 and 88 of each cavity serve as force transmitting surfaces in that they are against the surfaces 54 and 58 of the ears of the terminal in the cavity and the surfaces 54 and 58 likewise serve as force transmitting surfaces in that they transmit forces to the post portion 30 of the terminal during assembly of that connector to the mother board. It is advantageous that a relatively extensive area is provided on these surfaces for the reason that a relatively high insertion force is transmitted through the housing to the terminal during assembly. A further advantage of the arrangement shown is that the summation of the forces transmitted through the housing to the ears can be represented as a vertical vector which will lie relatively close to the longitudinal axis of the terminal. Ideally, this vector should lie on the terminal axis however it is impractical to design the terminal of FIGS. 2–7 such that axial loading of the terminal is achieved. The disclosed arrangement provides loading on the terminals which is very close to axial loading and which is from this standpoint very efficient.

Advantageously, standoff ribs 90 extend across the mounting face of the housing between adjacent rows of terminal-receiving cavities. These ribs will maintain the mounting face spaced above the surface of the mother board and are useful when the assembly is mounted on the mother board.

It will be apparent from the foregoing description that assembly of the connector assembly to the other board merely requires that the pins be aligned with the plated holes in the mother board 6 and initially inserted into these holes. When the compliant portions 38 of the pins come into engagement with the surface 4, a normal force is applied uniformly over the mating face 18 of the housing and transmitted through the housing, through the force transmitting surfaces described above to the terminal posts so that the posts are driven into the plated holes. The invention thus avoids the need of separate insertion punches for each of the terminals and avoids the requirement of a two-piece housing as explained above.

FIG. 8 shows an alternative embodiment of the invention comprising a terminal which has a post portion 30, a compliant portion 38, a yoke portion 32, and a shank portion 34 from which a contact portion (not shown) extends. In this embodiment, the ears 92, 94 extend in opposite oblique directions and the cavity in the connector housing will have ear-receiving recesses (similar to the recesses 84) on opposite sides of the center line of the cavity. This embodiment of the invention can be used under some circumstances such as where the contact portion of the terminal is an axial extension of the shank 34. When a connector of the type shown in FIG. 8 is assembled to a circuit board 6 by applying force to the mating face 18, the forces will be applied to the terminal on opposite sides of the axis and the resultant force will be along the axis of the terminal.

I claim:

1. An electrical connector assembly of the type comprising an insulating housing having a mounting face and an opposite face which is oppositely directed with respect to the mounting face, a plurality of terminal receiving cavities extending into the housing from the mounting face, a stamped and formed sheet metal terminal in each of the cavities, each of the terminals having rolled surface portions and sheared surface portions, each of the terminals having a post portion which extends outwardly from the mounting face, the connector assembly being intended for mounting on one surface of a panel with the mounting face opposed to the one surface of the panel and with the post portions extending into post-receiving holes in the panel and having an interference fit in the post-receiving holes, the connector assembly having force receiving and transmitting portions which receive insertion forces and transmit the insertion forces to the post portions when the connector assembly is assembled to the panel and the post portions are forced into the post-receiving holes in the panel, the connector assembly being characterized in that:

each of the terminals has a longitudinal terminal axis extending inwardly from the mounting face towards the opposite face, each terminal further having a yoke portion which is proximate to the mounting face, a shank portion extending along the terminal axis towards the opposite face centrally from the yoke portion, and a pair of ears extending from the yoke portion on a first pair of opposite sides of the shank portion, the ears extending laterally of the terminal axis, the first pair of opposite sides of the shank portion being said sheared surface portions, the ears each having a fixed end which is integral with the yoke portion and a free end, the ears extending towards the opposite face and obliquely away from the terminal axis at an angle in the range of 30° to 60°, the yoke portion having a major rolled surface portion and side sheared surface portions, the ears having rolled surface portions extending from the rolled surface portions of the yoke portion and having sheared surface portions at their free ends, the sheared surface portions and the rolled surface portions of the ears facing towards the opposite face of the housing, the rolled surface portions and the sheared surface portions of the ears being force transmitting surface portions which face towards the opposite face, each of the cavities being enlarged adjacent to the mounting face for reception of the yoke portion and the ears and having force transmitting cavity wall surface portions which are opposed to, and against, the force transmitting surface portions of the ears whereby upon locating the connector assembly adjacent to the one surface of the panel with the post portions of the terminals extending into the post-receiving holes and upon application of insertion forces to the opposite face, the opposite face will function as a force-receiving face and the insertion forces will be transmitted through the housing and through the force transmitting surface portions of the cavities and the ears to the posts and the posts will be driven into the post-receiving holes.

2. An electrical connector assembly as set forth in claim 1 characterized in that the ears extend laterally of the terminal axis in the same direction.

3. An electrical connector assembly as set forth in claim 1 characterized in that the ears extend laterally of the terminal axis in opposite directions.

4. An electrical connector assembly as set forth in claim 1 characterized in that the terminal-receiving cavities extend through the housing from the mounting face to the opposite face, the opposite face being the mating face.

5. An electrical connector assembly as set forth in claim 4 characterized in that the housing is a one-piece molding, the terminals having been inserted into the housing from the mounting face, the yoke portions of the terminals having rearwardly facing shoulder surfaces which are co-planar with the mounting face

* * * * *